US010167148B2

(12) United States Patent
Kuno et al.

(10) Patent No.: US 10,167,148 B2
(45) Date of Patent: Jan. 1, 2019

(54) IMAGE FORMING APPARATUS AND DUSTPROOF COVER

(71) Applicants: Satoshi Kuno, Tokyo (JP); Hajime Nishida, Kanagawa (JP); Hideki Tobinaga, Kanagawa (JP); Jumpei Aoyama, Kanagawa (JP); Junpei Kamichi, Tokyo (JP); Shun Kobayashi, Kanagawa (JP); Manabu Nonaka, Kanagawa (JP)

(72) Inventors: Satoshi Kuno, Tokyo (JP); Hajime Nishida, Kanagawa (JP); Hideki Tobinaga, Kanagawa (JP); Jumpei Aoyama, Kanagawa (JP); Junpei Kamichi, Tokyo (JP); Shun Kobayashi, Kanagawa (JP); Manabu Nonaka, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 15/493,897

(22) Filed: Apr. 21, 2017

(65) Prior Publication Data

US 2017/0227911 A1 Aug. 10, 2017

Related U.S. Application Data

(63) Continuation of application No. PCT/JP2015/078118, filed on Oct. 2, 2015.

(30) Foreign Application Priority Data

Oct. 24, 2014 (JP) ..... 2014-217505

(51) Int. Cl.
*B65H 3/06* (2006.01)
*G03G 15/00* (2006.01)
(Continued)

(52) U.S. Cl.
CPC ..... *B65H 3/0661* (2013.01); *B65H 1/02* (2013.01); *B65H 1/26* (2013.01); *B65H 31/20* (2013.01);
(Continued)

(58) Field of Classification Search
CPC ... B65H 1/00; B65H 1/02; B65H 1/04; B65H 1/26; B65H 3/0661; B65H 2405/115;
(Continued)

(56) References Cited

U.S. PATENT DOCUMENTS 4,974,033 A * 11/1990 Yamada ..... G03G 15/234 399/124
7,245,869 B2 * 7/2007 Kim ..... G03G 15/6502 399/377
(Continued)

FOREIGN PATENT DOCUMENTS

CN 1219473 A 6/1999
CN 1636848 A 7/2005
(Continued)

OTHER PUBLICATIONS

International Preliminary Report on Patentability dated May 17, 2016 issued in corresponding International Application No. PCT/JP2015/078118 (with English translation).
(Continued)

*Primary Examiner* — Prasad V Gokhale
(74) *Attorney, Agent, or Firm* — Harness, Dickey & Pierce, P.L.C.

(57) ABSTRACT

An image forming apparatus includes an image forming unit, a paper loading base on which manual-feed paper is loaded, a manual-feed paper conveying unit, and a dustproof cover which covers the paper loading base being in the overhang state. The paper loading base has a lower end rotatably supported on one outer surface portion of the
(Continued)

device main body, and is opened from an upper end thereof and disposed at a predetermined oblique angle or in a horizontal overhang state such that an overhang side becomes an upper side in an oblique direction. The manual-feed paper conveying unit is conveys the manual-feed paper on the paper loading base onto a paper conveyance path one by one. The dustproof cover includes a base which engages with the paper loading base, and an opening-and-closing cover which is rotatably connected to the base and is opened upwardly on the overhang side.

9 Claims, 10 Drawing Sheets

(51) Int. Cl.

| | |
|---|---|
| ***G03G 21/16*** | (2006.01) |
| ***B65H 1/02*** | (2006.01) |
| ***B65H 1/26*** | (2006.01) |
| ***B65H 31/20*** | (2006.01) |
| ***B65H 85/00*** | (2006.01) |

(52) U.S. Cl.
CPC ..... *B65H 85/00* (2013.01); *G03G 15/6514* (2013.01); *G03G 15/6579* (2013.01); *G03G 21/1633* (2013.01); *G03G 21/1638* (2013.01); *B65H 2402/31* (2013.01); *B65H 2405/115* (2013.01); *B65H 2405/12* (2013.01); *B65H 2407/21* (2013.01); *B65H 2407/32* (2013.01); *B65H 2407/51* (2013.01); *G03G 2215/00438* (2013.01); *G03G 2221/1672* (2013.01)

(58) Field of Classification Search
CPC ..... B65H 2405/12; B65H 2405/324; B65H 2405/354; B65H 2407/21; B65H 2407/32; B65H 2407/51; B65H 2601/261; B65H 2601/2611; B65H 2601/325; G03G 15/6514
See application file for complete search history.

(56) References Cited

U.S. PATENT DOCUMENTS

| | | | | |
|---|---|---|---|---|
| 7,515,866 | B2 | 4/2009 | Togashi et al. | |
| 7,673,984 | B2 | 3/2010 | Nonaka | |
| 7,758,044 | B2 | 7/2010 | Nonaka | |
| 2003/0155702 | A1 | 8/2003 | Togashi et al. | |
| 2005/0073087 | A1* | 4/2005 | Kadowaki | B65H 3/0684 271/118 |
| 2005/0140083 | A1* | 6/2005 | Koga | B65H 3/00 271/121 |
| 2006/0056901 | A1* | 3/2006 | Shiraishi | B65H 1/266 400/625 |
| 2007/0127090 | A1 | 6/2007 | Nonaka | |
| 2009/0047038 | A1* | 2/2009 | Kobayashi | G03G 15/6511 399/114 |
| 2010/0109227 | A1 | 5/2010 | Higaki et al. | |
| 2011/0049791 | A1* | 3/2011 | Osakabe | B65H 3/0684 271/225 |
| 2012/0206552 | A1* | 8/2012 | Uchino | B41J 29/13 347/108 |
| 2013/0161897 | A1* | 6/2013 | Matsumoto | B65H 1/04 271/121 |
| 2014/0183813 | A1 | 7/2014 | Aoyama | |
| 2014/0210157 | A1 | 7/2014 | Aoyama | |
| 2014/0212195 | A1 | 7/2014 | Aoyama | |
| 2014/0291917 | A1* | 10/2014 | Uchino | B65H 1/02 271/147 |
| 2014/0319760 | A1* | 10/2014 | Komuro | B65H 31/20 271/223 |
| 2015/0132039 | A1 | 5/2015 | Tobinaga et al. | |
| 2015/0132040 | A1 | 5/2015 | Aoyama et al. | |
| 2015/0158686 | A1* | 6/2015 | Sugiyama | B65H 3/0684 271/109 |
| 2015/0274451 | A1* | 10/2015 | Ukai | B65H 1/02 271/9.08 |
| 2016/0332828 | A1* | 11/2016 | Wakakusa | B65H 1/04 |

FOREIGN PATENT DOCUMENTS

| | | | | |
|---|---|---|---|---|
| CN | 1717362 | A | 1/2006 | |
| CN | 102632727 | A | 8/2012 | |
| JP | 61141577 | A * | 6/1986 | B41J 13/103 |
| JP | 2009-046229 | | 3/2009 | |
| JP | 2009-057173 | | 3/2009 | |
| JP | 2009-265249 | | 11/2009 | |

OTHER PUBLICATIONS

International Search Report dated Dec. 28, 2015 in PCT/JP2015/078118 filed on Feb. 10, 2015.
Chinese Office Action for corresponding Chinese Patent Application No. 2015800566712 dated Jan. 8, 2018.

* cited by examiner

IMAGE FORMING APPARATUS AND DUSTPROOF COVER

CROSS-REFERENCE TO RELATED APPLICATIONS

This application is a continuation of PCT international Application Ser. No. PCT/JP2015/078118, filed on Oct. 2, 2015, which designates the United States and which claims the benefit of priority from Japanese Patent Application No. 2014-217505, filed on Oct. 24, 2014; the entire contents of which are incorporated herein by reference.

BACKGROUND OF THE INVENTION

1. Field of the Invention

The present invention relates to an image forming apparatus provided with a manual paper feeding mechanism including a dustproof cover, such as a printer device and a copier, and a dustproof cover.

2. Description of the Related Art

In the related art, an intermediate transfer type image forming apparatus is known in which toner images on a photoconductor drum are primarily transferred onto an intermediate transfer belt, and the toner images which are transferred onto the intermediate transfer belt are collectively secondarily transferred onto paper (for example, refer to Patent Literature 1).

However, recently, an image forming apparatus provided with a manual paper feeding mechanism has been provided, and a paper placing tray which is a manual paper feeding tray is attached to a device main body to be openable and closable. In a case where the paper placing tray is used in an opened state under a circumstance where the image forming apparatus main body is disposed, there is a possibility that foreign substance such as dust enters the inside from a certain portion, and thus, a dustproof cover is detachably attached to the paper placing tray.

However, in the manual paper feeding mechanism of the image forming apparatus described above, the dustproof cover is a single molded body, and the entire dustproof cover securely fits into the paper loading base, and thus, it takes time to perform the attachment or the detachment of the dustproof cover, and it is necessary to detach the dustproof cover in order to replenish the paper.

SUMMARY OF THE INVENTION

According to one aspect of the present invention, an image forming apparatus includes an image forming unit, a paper loading base on which manual-feed paper is loaded, a manual-feed paper conveying unit, and a dustproof cover which covers the paper loading base being in the overhang state. The image forming unit forms an image on paper being conveyed on a paper conveyance path provided in a device main body. The paper loading base has a lower end rotatably supported on one outer surface portion of the device main body, and is opened from an upper end thereof and disposed at a predetermined oblique angle or in a horizontal overhang state such that an overhang side becomes an upper side in an oblique direction. The manual-feed paper conveying unit is disposed in a position corresponding to the paper loading base in the device main body and conveys the manual-feed paper loaded on the paper loading base onto the paper conveyance path one by one. The dustproof cover includes a base which engages with the paper loading base, and an opening-and-closing cover which is rotatably connected to the base and is opened upwardly on the overhang side.

BRIEF DESCRIPTION OF THE DRAWINGS

The accompanying drawings are intended to depict exemplary embodiments of the present invention and should not be interpreted to limit the scope thereof. Identical or similar reference numerals designate identical or similar components throughout the various drawings.

DESCRIPTION OF THE EMBODIMENTS

Figure 1:
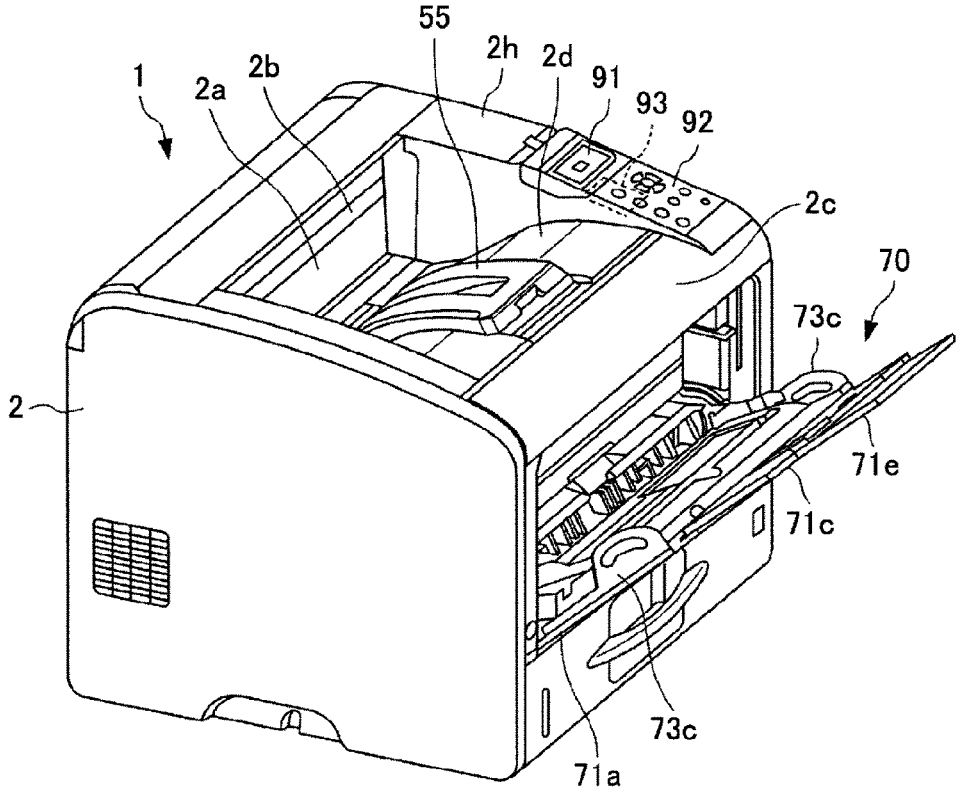
FIG. 1 is a perspective view of an image forming apparatus according to an embodiment viewed from an oblique upper left direction when a paper loading base is opened.
Figure 2:
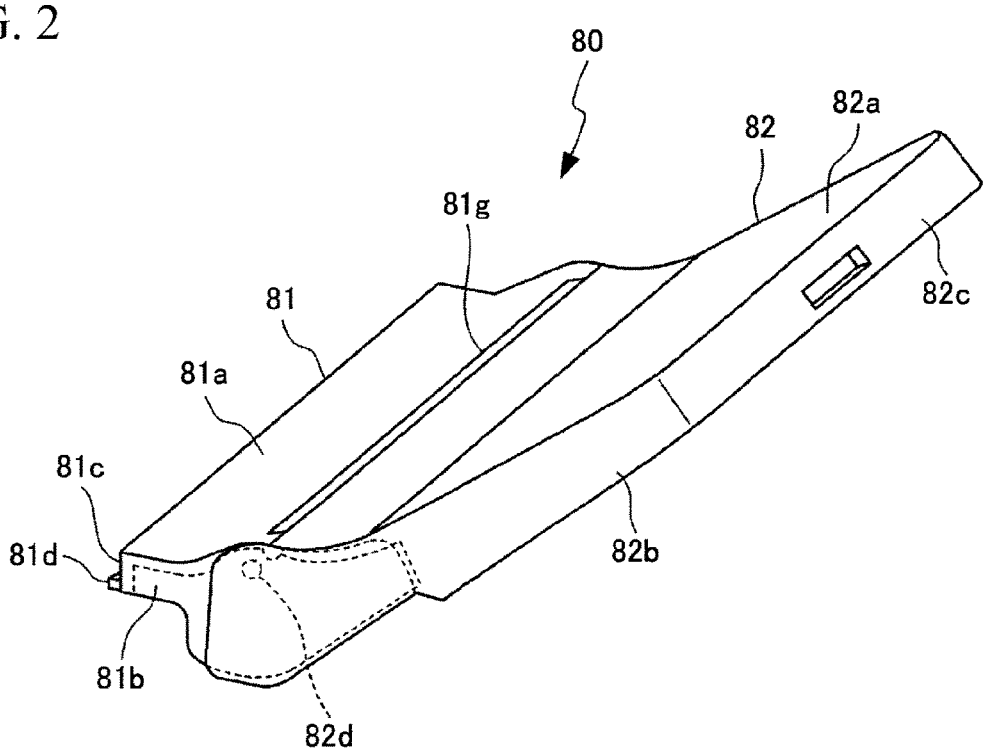
FIG. 2 is a perspective view of a dustproof cover covering the paper loading base of the image forming apparatus according to the embodiment viewed from the oblique upper left direction.

The terminology used herein is for the purpose of describing particular embodiments only and is not intended to be limiting of the present invention.

As used herein, the singular forms "a", "an" and "the" are intended to include the plural forms as well, unless the context clearly indicates otherwise.

In describing preferred embodiments illustrated in the drawings, specific terminology may be employed for the sake of clarity. However, the disclosure of this patent specification is not intended to be limited to the specific terminology so selected, and it is to be understood that each specific element includes all technical equivalents that have the same function, operate in a similar manner, and achieve a similar result.

An object of an embodiment is to provide an image forming apparatus provided with a manual paper feeding mechanism including a dustproof cover that is easily attached to and detached from a paper loading base, and the replenishment of the manual-feed paper is easily performed since the dustproof cover can be retained in a widely opened state without being detached, and a dustproof cover.

Hereinafter, a case where an image forming apparatus of an embodiment is applied to a printer device in a quadruple tandem type intermediate transfer system will be described with reference to the drawings as an embodiment according to the image forming apparatus of the embodiment.

Figure 3:
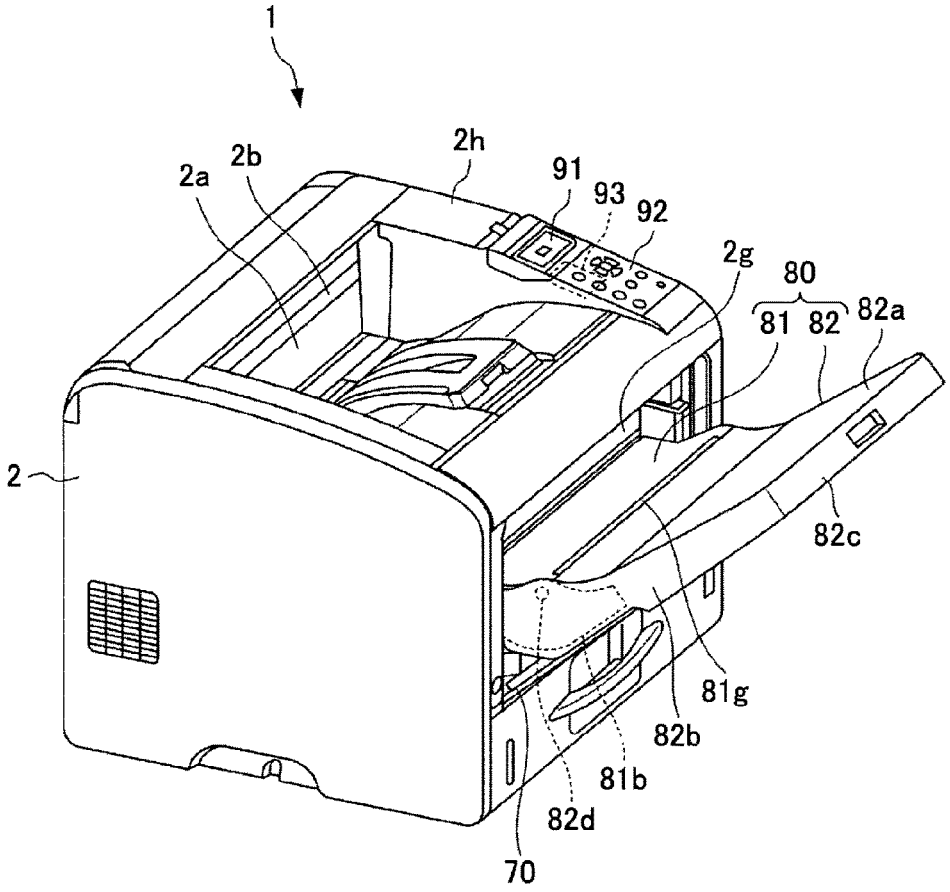
FIG. 3 is a perspective view of the image forming apparatus according to the embodiment viewed from the oblique upper left direction when the paper loading base is covered with the dustproof cover.
Figure 4:
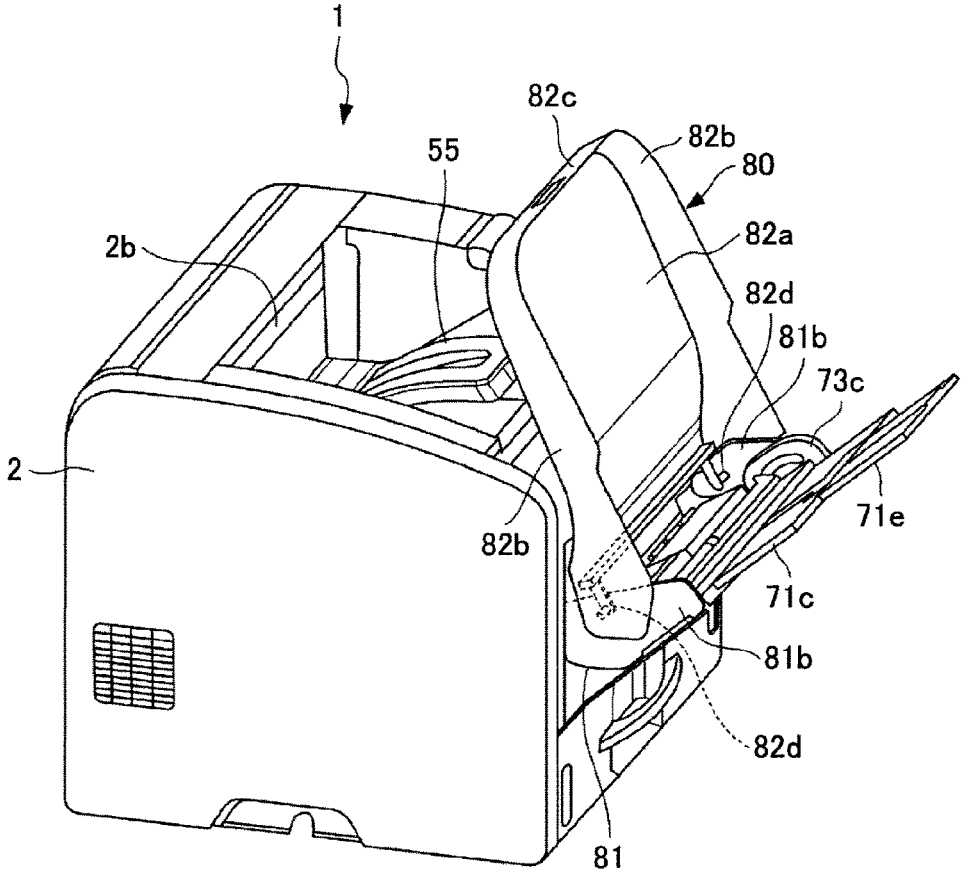
FIG. 4 is a perspective view of the image forming apparatus according to the embodiment viewed from the oblique upper left direction when an opening-and-closing cover of the dustproof cover covering the paper loading base is opened.

First, a schematic configuration of a printer device 1 according to this embodiment will be described with reference to FIG. 1 to FIG. 4. As illustrated in FIG. 1, the printer device 1 includes a paper loading base 70 which overhangs in an oblique state when opened to a front side. In particular, the printer device 1 includes a dustproof cover 80 for covering paper loaded on the paper loading base 70, illustrated in FIG. 2. As illustrated in FIG. 3, the dustproof cover 80 shields the paper loading base 70 and prevents dust from being deposited on the paper loaded on the paper loading base 70. The dustproof cover 80 includes a base 81 and an opening-and-closing cover 82. As illustrated in FIG. 4, the printer device 1 stops the opening-and-closing cover 82 in a leaned state without detaching the dustproof cover 80, and replenishes the paper. Furthermore, the device main body 2 includes a panel display section 91 and an operation unit 92 in an upper surface side portion 2*h*, and includes therein a main body control unit 93. Hereinafter, the details will be described.

Figure 5:
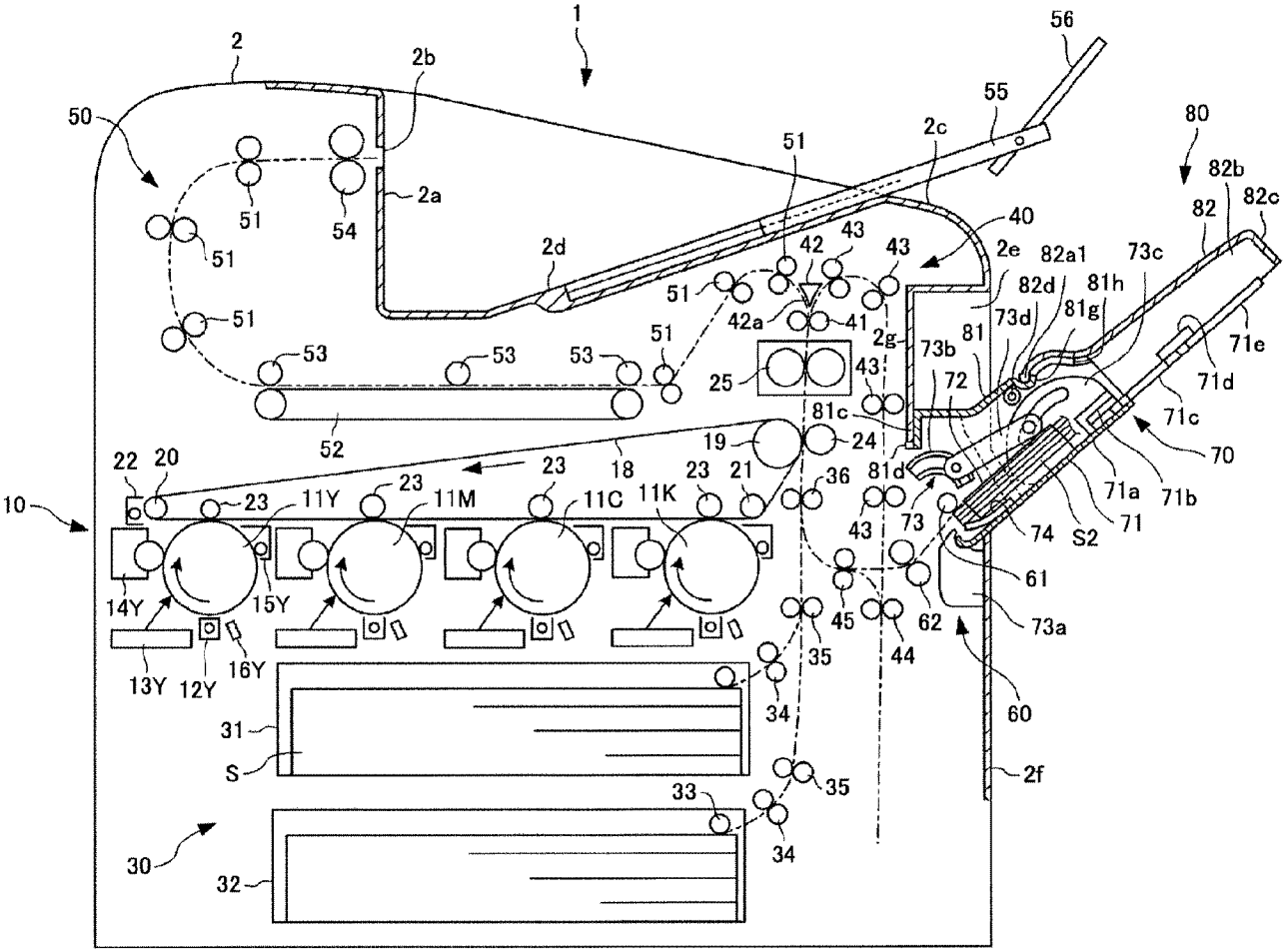
FIG. 5 is a schematic vertical sectional side view illustrating an interior configuration of the image forming apparatus according to the embodiment.

As illustrated in FIG. 5, the printer device 1 includes an image forming unit 10 formed of a four-color image formation station, a fixing unit 25, a paper feeding unit 30, a registration roller pair 36, a paper reversing unit 40, and a paper ejection conveying unit 50 in the device main body 2, and performs four-color printing by being controlled by the main body control unit 93.

Further, in the printer device 1, the paper ejection conveying unit 50 ejects paper from a paper ejection port 2*b* of a step portion both ends 2*a* formed in a rear side upper portion of the device main body 2 and transports the ejected paper to a front-side upper surface portion 2*c* of the device main body 2, and the printer device 1 includes an extension tray for receiving ejected paper 55 receiving a large-size paper which is ejected from the paper ejection conveying unit 50 in the front-side upper surface portion 2*c* of the device main body 2, and includes a manual-feed paper conveying unit 60 on a front side in the device main body 2, and the paper loading base 70 overhanging by being opened to the front side of the device main body 2. Accordingly, a user stands in the front of the device main body 2 and performs an extraction operation of a printed paper which is ejected and a paper replenishment operation of manual-feed paper.

As illustrated in FIG. 5, the image forming unit 10 includes photoconductors 11Y, 11M, 11C, and 11K which are latent image bearers for four colors arranged side by side along a lower side extended surface (stretched surface) of an intermediate transfer belt 18 described below, toner image forming units 12 to 16 forming an one-color toner image on each of the photoconductors 11Y, 11M, 11C, and 11K, the intermediate transfer belt 18 which is an intermediate transfer body bearing the toner image formed on each of the photoconductors 11Y, 11M, 11C, and 11K, and a secondary transfer roller 24 secondarily transferring the toner images for four colors borne in four layers on the intermediate transfer belt 18 onto paper S. Furthermore, in the addition to the reference numeral of the photoconductor, Y indicates yellow, M indicates magenta, C indicates cyan, and K indicates black.

In a case of describing the toner image forming units 12 to 16, for example, by using the configuration of a yellow image formation station as a representative, a charger 12Y as a charging means charging a front surface of the photoconductor, a laser scanning unit 13Y as an exposure means, a developing unit 14Y as a developing means, primary transfer rollers 23 which are arranged corresponding to the photoconductors 11Y, 11M, 11C, and 11K and press the upper-side extended surface (stretched surface) of the intermediate transfer belt 18 against the photoconductors 11Y, 11M, 11C, and 11K, a photoconductor cleaning unit 15Y removing a transfer residual toner which is attached onto the front surface of the photoconductor, and a quenching lamp 16Y as a discharging means discharging the front surface of the photoconductor are provided around the photoconductors 11Y, 11M, 11C, and 11K in this order in a rotation direction. The same applies to image formation stations of other colors.

The intermediate transfer belt 18 is formed in an endless state, and is supported by a first stretch roller 19, a second stretch roller 20, and a third stretch roller 21, as a plurality of supporting members to be capable of endlessly traveling. A belt cleaning unit 22 is disposed in a portion facing the second stretch roller 20. The secondary transfer roller 24 is disposed on a rotation pulley in a position facing the first stretch roller 19. The secondary transfer roller 24 presses the paper S against the intermediate transfer belt 18.

In this embodiment, the fixing unit 25 fixing the toner image which is transferred onto the paper S is disposed in an upper side position of the first stretch roller 19 and the secondary transfer roller 24, on a downstream side of a secondary transfer position in a paper conveyance direction.

Therefore, toner images of four colors of yellow (Y), magenta (M), cyan (C), and black (K) are formed on the front surfaces of the photoconductors 11Y, 11M, 11C, and 11K, which are the latent image bearers, the four-color toner image is primarily transferred onto a front surface of the intermediate transfer belt 18, which is the intermediate transfer body, on an outer circumference side as a four-layer toner image, the four-layer toner image is secondarily transferred onto the paper S which is conveyed from a lower side to a secondary transfer position of the intermediate transfer belt 18 and the secondary transfer roller 24, and is heated and pressurized by the fixing unit 25, and thus, the four-layer toner image is fixed onto the paper S, and printing is performed.

The paper feeding unit 30 includes a first paper feeding hopper 31 and a second paper feeding hopper 32 which are disposed in two steps in a lower portion of the device main body 2, a pickup roller 33 and a paper feeding roller pair 34 which are attached to each of the paper feeding hoppers and feed the paper S contained in each of the paper feeding hoppers one by one, and upper feeding roller pairs 35 and 35 conveying the paper S fed from one paper feeding hopper to an upper side, which are upper feeding paper conveying units. The paper S is formed of transfer paper, a resin film, or the like. The registration roller pair 36 is positioned immediately under the secondary transfer roller 24 and the intermediate transfer belt 18, which is the secondary transfer position, and is positioned on an upper side of the paper feeding roller pair 34, and thus, continuously conveys the paper S which is conveyed by the paper feeding roller pair 34 to the secondary transfer position of the secondary transfer roller 24 and the intermediate transfer belt 18.

The user selects one paper feeding hopper to be used from the first paper feeding hopper 31 and the second paper feeding hopper 32 by an input terminal such as a PC (not illustrated) of which the system is configured by being connected to the main body control unit 93 or a network, and the paper S contained in the selected paper feeding hopper is conveyed towards the secondary transfer position to continue to the registration roller pair 36 one by one.

The paper reversing unit 40 includes a guide roller pair 41 disposed in an immediately upper position of the fixing unit 25, a bifurcating claw 42 disposed in an immediately upper position of the guide roller pair 41, a plurality of guide roller pairs 43 guiding the paper S to be lowered to the device front side from a fed paper conveyance path of the paper feeding unit 30 from the bifurcating claw 42, a switchback roller pair 44 disposed on a lower side of the guide roller pair 43, and a relay roller pair 45 conveying the upper-fed paper S to continue to the registration roller pair 36 in the switchback roller pair 44.

The bifurcating claw 42 has a sphenoidal shape including a front side oblique surface and a rear side oblique surface interposing a downward claw tip portion 42*a* therebetween, and the claw tip portion 42*a* is positioned on a front side or a rear side by an actuator (not illustrated). The switchback roller pair 44 is disposed to perform a required intermittent rotation in one direction and a required intermittent rotation in the other direction according to the conveyance of the paper S. The guide roller pair 43 is also disposed to perform required intermittent rotation according to the conveyance of the paper S.

In the bifurcating claw 42, the claw tip portion 42*a* is positioned on the front side in an one side printing mode, and thus, the paper S is guided towards the paper ejection conveying unit 50, the claw tip portion 42*a* is positioned on the rear side in a both side printing mode at a time point where the one side printing ends, and thus, the paper S is guided to the paper reversing unit 40, and the claw tip portion 42*a* is positioned on the front side at a time point where the both side printing ends, and thus, the paper S is guided towards the paper ejection conveying unit 50.

The paper reversing unit 40 guides the paper S which is guided by the bifurcating claw 42 at the time point where the one side printing ends, to the switchback roller pair 44 by the plurality of guide roller pairs 43, the switchback roller pair 44 stops the rotation immediately before the paper S passes through the switchback roller pair 44, and reverses the rotation, and thus, the paper feeding is changed to the upper feeding, and then, the paper S is continuously conveyed to the registration roller pair 36 by a reverse guide (not illustrated) through the relay roller pair 45.

The paper ejection conveying unit 50 includes a plurality of paper ejection guide roller pairs 51 guiding the printed paper S which is guided by the bifurcating claw 42 to a rear portion of the device main body 2 in the one side printing mode, and in the both side printing mode when the both side printing ends, a paper ejection belt conveying unit 52, a plurality of suppression rollers 53, and a paper ejection roller pair 54 disposed on the inside of the step portion both ends 2*a* on a rear side of the device main body 2. The paper ejection roller pair 54 ejects printed paper S towards the front-side upper surface portion 2*c* along a center oblique surface portion 2*d* which is a rising slope to the front side of the device main body 2.

The center oblique surface portion 2*d* of the device main body 2 includes the drawable extension tray for receiving ejected paper 55 to receive largest-size paper which is not contained in the center oblique surface portion 2*d*. Further, the extension tray for receiving ejected paper 55 includes an expanding auxiliary tray 56 which is capable of extending to open a part thereof to the front side from a state of being drawn to overhang to the front side of the device main body 2.

Hereinafter, the paper loading base 70 which is the characteristic configuration of this embodiment, and a manual-feed paper conveyance mechanism will be described with reference to FIG. 5 to FIG. 14.

A front-side outer surface portion 2*f* of the device main body 2 includes a paper loading base container 2*e*, which is an approximately rectangular parallelepiped recess for containing the paper loading base 70. In the paper loading-base container 2*e*, a lower half portion is opened, and a manual-feed paper-pickup roller 61 and a manual-paper feeding roller pair 62 configuring the manual-feed paper conveying unit 60 are disposed in the lower half portion.

The manual-feed paper pickup roller 61 is closely in contact with manual-feed paper S2 loaded on the paper loading base 70 when the paper loading base 70 described below, which is contained in the paper loading base container 2*e*, is opened in an overhang state which is oblique from the upper end, and transports the manual-feed paper S2 one by one.

The manual-paper feeding roller pair 62 is positioned on the device front side from the switchback roller pair 44, and has a height level coincident with a height level of the relay roller pair 45, and thus, continuously conveys the manual-feed paper S2 which is transported by the manual-feed paper pickup roller 61 one by one to the relay roller pair 45. That is, this embodiment employs a both side printing type in which the paper reversing unit 40 is disposed on the front side of the device main body 2, and thus, a conveyance path of the manual-paper feeding roller pair 62 intersects with a paper conveyance path of the paper reversing unit 40 in an immediately upper portion of the manual-feed paper pickup roller 61. Therefore, the manual-feed paper conveying unit 60 delivers the manual-feed paper S2 to the paper reversing unit 40. In the paper reversing unit 40, the paper conveyance path of the manual-feed paper conveying unit 60 intersects with a reversed paper conveyance path of the paper reversing unit 40, and thus, the manual-feed paper S2 which is conveyed from the manual-feed paper conveying unit 60 is also continuously conveyed to the relay roller pair 45.

The paper loading base 70 includes a base plate 71, a manual-feed-paper regulation plate pair 72, a pair of base plate retainers 73, and a push-up plate 74. The base plate 71 is level with the front-side outer surface portion 2*f* of the device main body 2 when completely closing the paper loading-base container 2*e*. The manual-feed-paper regulation plate pair 72 is disposed in an inner surface (an upper surface at the time of overhanging) of the base plate 71 to be capable of being positioned in a width direction and positions the manual-feed paper S2 loaded on the base plate 71 in the width direction. The pair of base plate retainers 73 are disposed to retain both-side end portions of the inner surface of the base plate 71 and retain the base plate 71 in an oblique state at the time of being opened to the outside from the upper end. The push-up plate 74 is lifted up by a spring (not illustrated) such that an upper surface of a tip portion of the manual-feed paper S2 loaded on the base plate 71 in the oblique state is closely in contact with the manual-feed paper-pickup roller 61, and presses a lower surface of the tip portion of the manual-feed paper S2 to an upper side.

In this embodiment, the base plate 71 includes a first extension base plate 71*c* and a second extension base plate 71*e*. The first extension base plate 71*c* is retained by a first guide frame 71*b* disposed in both lateral portions of an upper surface of a base plate main body 71*a* to overlap with the base plate main body 71*a*, and is capable of being drawn. The second extension base plate 71*e* is retained by a second guide frame 71*d* disposed in the first extension base plate 71*c* to overlap with the first extension base plate 71*c*, and is capable of being drawn. In a state where the first extension base plate 71*c* and the second extension base plate 71*e* are drawn, large-size paper is loaded. Furthermore, the extension base plate may be a one-stage extension type base plate in addition to a two-stage extension type base plate.

The base plate retainer 73 is configured to retain the base plate 71 in the oblique state where the manual-feed paper S2 loaded on the base plate 71 is oblique at an oblique angle smaller than an oblique angle at which sliding occurs due to a gravity action. In this embodiment, the base plate retainer 73 includes a support block 73*a*, a guide with an arc-like groove 73*b*, a cam plate 73*c*, and a swing link 73*d*. The support block 73*a* is disposed in a position facing the inside of a lower end portion of the base plate 71 when the base plate 71 is in a state where the paper loading base container 2*e* is completely closed, receives the lower end portion of the base plate 71 in a concave surface when the base plate 71 is opened, and supports the lower end portion of the base plate 71 in a position where the lower end portion of the base plate 71 slightly slides to the inside. The guide with an arc-like groove 73*b* is disposed in both lateral portions of a lower portion of the paper loading-base container 2*e*. The cam plate 73*c* is fixed to an inner-surface-side end portion of the base plate 71 and has an arc-like guide slit. The swing link 73*d* includes a cam follower on both ends, and connects the guide with an arc-like groove 73*b* to the cam plate 73*c* while swinging the cam follower by guiding the cam follower to the arc-like groove of the guide with an arc-like groove 73*b* and the arc-like guide slit of the cam plate 73*c*.

With such a configuration, in a case where an upper end of the base plate retainer 73 is grabbed and is slightly lifted, the lower end portion of the base plate 71 is positioned in a slightly upper portion from the support block 73*a*. In this state, in a case where the upper end of the base plate retainer 73 is opened to the outside, the lower end portion of the base plate 71 is in a state of being received in the concave surface of the support block 73*a*, and then, the base plate 71 is oblique by using, as a rotation center, a sliding portion between the lower end portion of the base plate 71 and the concave surface of the support block 73*a*. For this reason, the lower end portion of the base plate 71 does not greatly enter the device main body 2.

The base plate retainer may be a support base which is disposed on an outer surface of the device main body 2 in the overhang state, instead of the base plate retainer having an embedded structure. In addition, the base plate retainer may be configured to retain the base plate 71 in a horizontal state.

As illustrated in FIG. 3 and FIG. 5, the dustproof cover 80 covers the paper loading base 70 being in the overhang state, and has a function of preventing dust from falling down on the manual-feed paper S2 loaded on the paper loading base 70.

Figure 6:
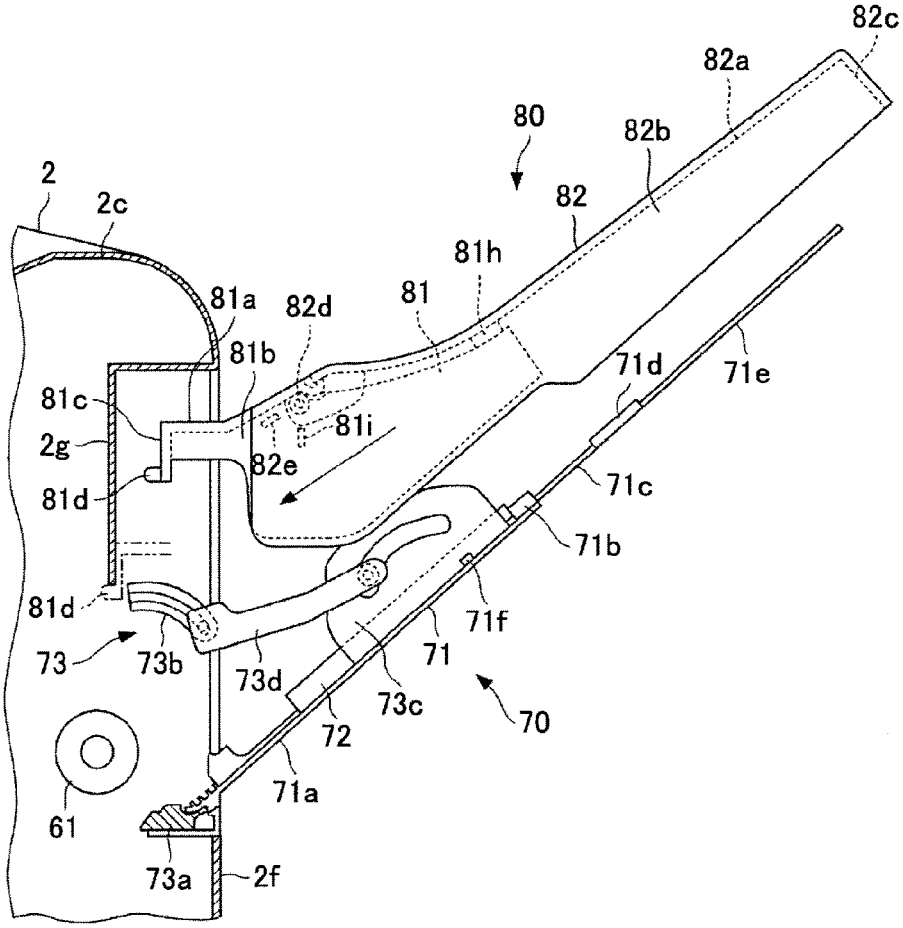
FIG. 6 is a side view illustrating a state in the middle of attaching the dustproof cover to the paper loading base which is a main part of the image forming apparatus according to the embodiment.
Figure 7:
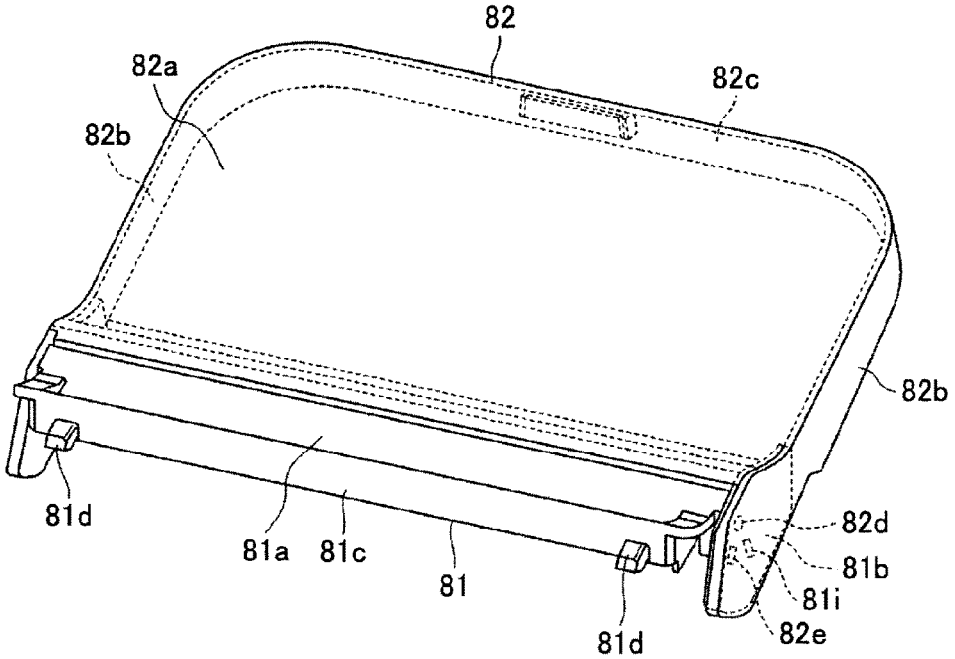
FIG. 7 is a perspective view illustrating the dustproof cover which is a main part of the image forming apparatus according to the embodiment.

As illustrated in FIG. 5 to FIG. 7, the dustproof cover 80 includes the base 81 and the opening-and-closing cover 82. The base 81 is disposed on the paper loading base 70 at a portion close to the device main body 2 in a detachably fixed state. The opening-and-closing cover 82 covers an overhang-side portion having a large area, which is not covered with the base 81, and is stopped by being opened upwardly on an overhang end side.

The base 81 is a transparent or semi-transparent plastic molded body, includes a base-side upper surface part 81*a* and a pair of base-side lateral surface parts 81*b*, and is mounted in a state of extending over the portion of the paper loading base 70 in the overhang state, which is close to the device main body 2 side. The base-side upper surface part 81*a* not only covers the portion of the paper loading base 70 close to the device main body 2 side but also horizontally enters the paper loading base container 2*e* and extends until the base-side upper surface part 81*a* is in contact with a front wall 2*g* forming the paper loading base container 2*e*, and a hanging portion 81*c* extends from the contact point. Furthermore, on a lower end of the hanging portion 81*c*, there is provided a floating preventive protrusion 81*d* which engages with a lower end surface of the front wall 2*g* (corresponding to the downward surface portion in the device main body) forming the paper loading base container 2*e*.

With this, the base 81 can be positioned, and it is possible to avoid the entrance of foreign substances due to a situation that the inner portion of the device main body 2 is viewed from the outside through the lower portion of the paper loading base container 2*e*.

The pair of base-side lateral surface parts 81*b* cover both outsides of a pair of cam plates 73*c* disposed at both lateral portions of the base plate main body 71*a*, and second protrusions 81*e* protruding towards the base plate main body 71*a* from a lower end surface are placed on the base plate main body 71*a*, so as to be in contact with end portions on both sides of the upper surface of the base plate main body 71*a*. First protrusions 71*f* respectively corresponding to the second protrusions 81*e* are disposed at end portions on both sides of the upper surface of the base plate main body 71*a* on an overhang side than the second protrusions 81*e*. Seating portions 81*f* and 81*f* are disposed on respective lower end surfaces of the pair of base-side lateral surface parts 81*b* at an end portion on the device main body 2 side and at an end portion on the overhang side. The seating portions 81*f* and 81*f* are in contact with the end portions on both sides of the upper surface of the base plate main body 71*a* along with the second protrusions 81*e*, and decrease a contact surface pressure.

As illustrated in FIG. 5 to FIG. 7, the opening-and-closing cover 82 is a transparent or semi-transparent plastic molded body, and includes a cover-side upper surface part 82*a*, a pair of cover-side lateral surface parts 82*b*, and a front portion 82*c*. The opening-and-closing cover 82 covers the overhang-side portion, which is not covered with the base 81, of the paper loading base 70 being in a state where the first extension base plate 71*c* and the second extension base plate 71*e* further extend from the base plate main body 71*a* being in an oblique overhang state. The base-side upper surface part 81*a* of the base 81 includes a supporting protrusion 81*h* which supports opening-and-closing cover 82 by being in contact with the cover-side upper surface part 82*a* of the opening-and-closing cover 82, at a position where the opening-and-closing cover 82 covers the paper loading base 70. With this, the opening-and-closing cover 82 is supported on the base 81 such that the cover-side upper surface part 82*a* is in a state of being separated from the manual-feed paper P2 loaded on the base plate main body 71*a* to the upper side by several mm to tens of mm. In a case where a downward external force is imparted to an overhang end of the cover-side upper surface part 82*a* from above, the external force is imparted to the base 81 through the supporting protrusion 81*h*. The base 81 includes the floating preventive protrusion 81*d* and has a floating prevention function, and thus, there is no concern that the dustproof cover 80 is unexpectedly detached by the external force. Furthermore, an engaging recess and an engaging protrusion may be disposed between the pair of base-side lateral surface parts 81*b* and the base plate main body 71*a*, as other locking sections of the base 81 for preventing the floating from the base plate main body 71*a*.

Figure 12:
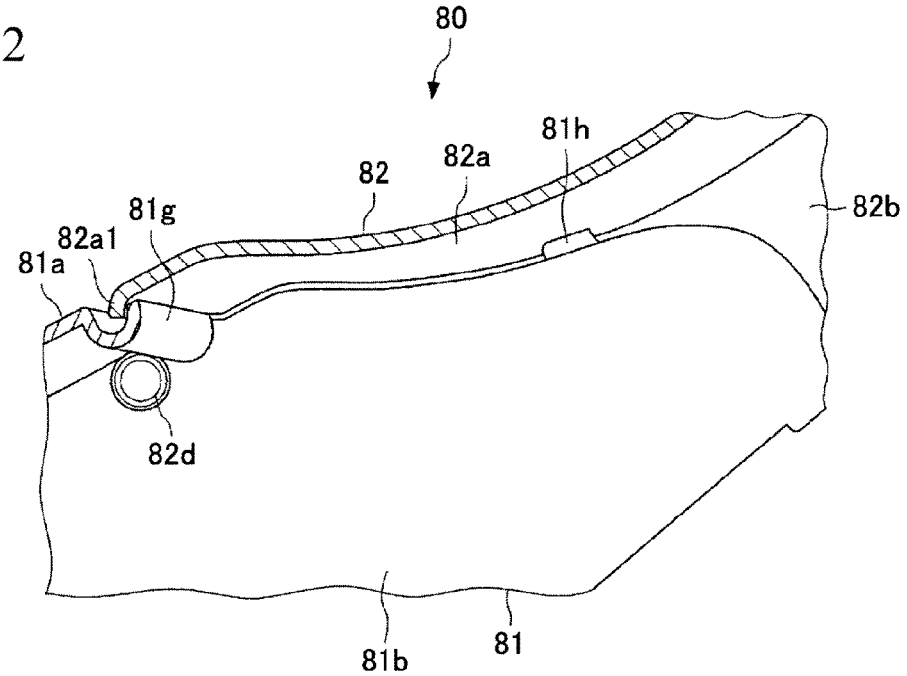
FIG. 12 is a perspective view illustrating a support state of a base of the dustproof cover, which is a main part of the image forming apparatus according to the embodiment, and the opening-and-closing cover, viewed from below.

As illustrated in FIG. 12, an end portion 82*a*1 of the cover-side upper surface part 82*a* close to the device main body 2 is slightly curved to fall down a gutter-like recess portion 81*g* formed in an overhang-side portion of the base-side upper surface part 81*a*. The pair of cover-side lateral surface parts 82*b* of the opening-and-closing cover 82 overlap with the base-side lateral surface parts 81*b* from the outside in a proximate state. As illustrated in FIG. 5, FIG. 6, and FIG. 12, in an upper portion of each of the pair of base-side lateral surface parts 81*b* of the base 81 close to the overhang side, a connecting unit 82*d* rotatably connecting the opening-and-closing cover 82 to the base 81 is provided. In this embodiment, the connecting unit 82*d* is configured of a shaft and a bearing, divided by the cover-side lateral surface part 82*b* and the base-side lateral surface part 81*b*. Therefore, the opening-and-closing cover 82 is opened upwardly on the overhang side by using the connecting unit 82*d* as a rotation center with respect to the base 81.

Here, a positional relationship among the second protrusion 81*e*, the first protrusion 71*f*, and the floating preventive protrusion 81*d* described above will be described in association with the attachment and the detachment of the base 81 with reference to FIG. 5, FIG. 6, and FIG. 8 to FIG. 11.

First, a case of attaching the base 81 will be described. As illustrated in FIG. 6, when the base 81 is positioned at a position immediately before the hanging portion 81*c* is in contact with the front wall 2*g* and immediately before the floating preventive protrusion 81*d* engages with the lower end surface of the front wall 2*g*, as illustrated by a dotted line in FIG. 9, the second protrusion 81*e* disposed closer to the device main body 2 than the first protrusion 71*f* is placed on the base plate main body 71*a* not to interfere the first protrusion 71*f*. Next, as illustrated in FIG. 5, in a case where the base 81 is moved such that the hanging portion 81*c* is in contact with the front wall 2*g*, and the floating preventive protrusion 81*d* engages with the lower end surface of the front wall 2*g*, the second protrusion 81*e* is separated from the first protrusion 71*f* to the device main body 2 side by a movement amount X. In a state illustrated in FIG. 5, the floating preventive protrusion 81*d* engages with the lower end surface of the front wall 2*g*, and thus, even in a case where an external force of causing the floating of the base 81 which occurs by pressing the overhang end of the opening-and-closing cover 82 to the lower side, is imparted to the base 81, the base 81 is assembled in the paper loading base 70 without occurring the floating of the base 81.

Figure 8:
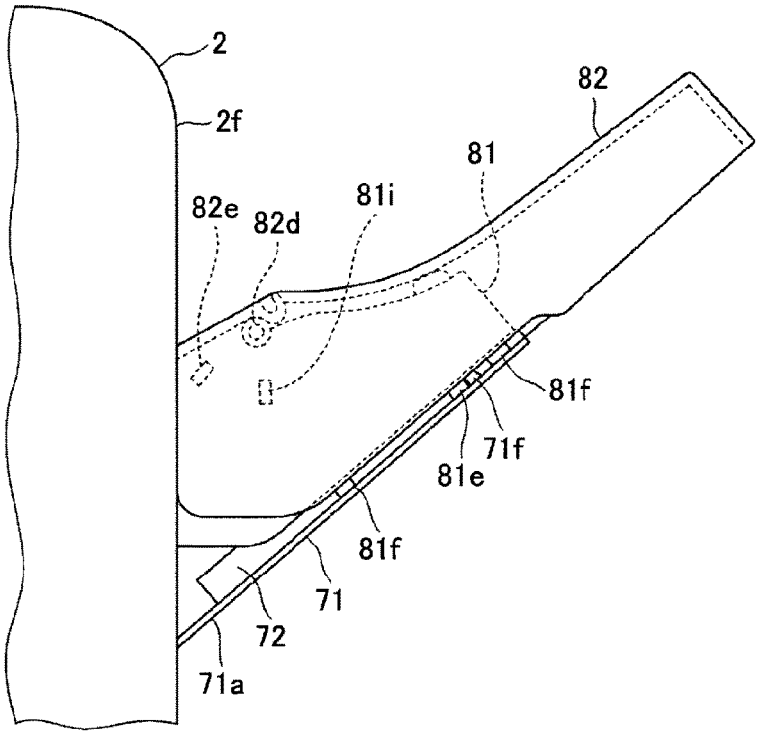
FIG. 8 is a side view illustrating a state where the dustproof cover is attached to the paper loading base which is a main part of the image forming apparatus according to the embodiment.
Figure 9:
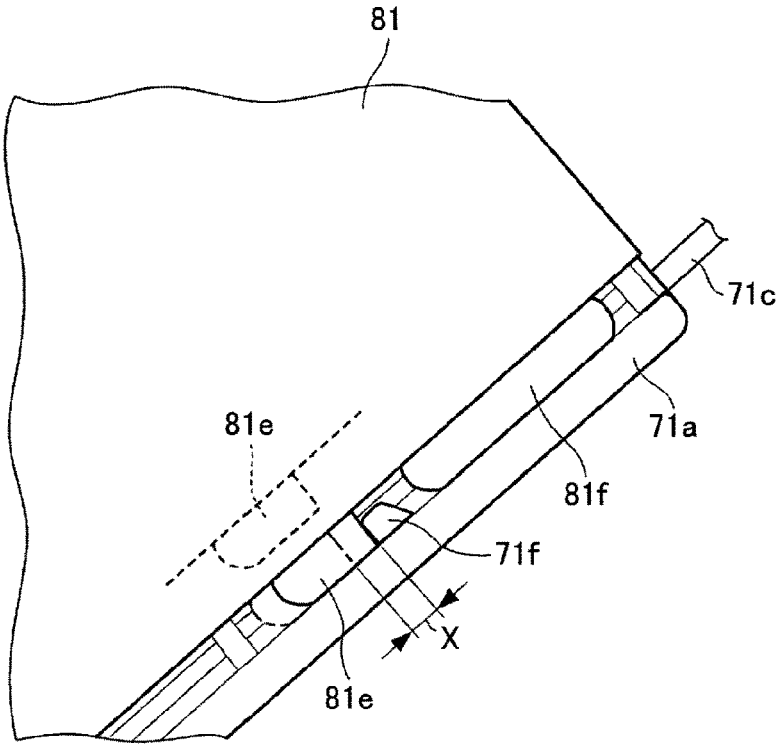
FIG. 9 is a partially enlarged side view illustrating a locking portion between the paper loading base, which is a main part of the image forming apparatus according to the embodiment, and the dustproof cover.
Figure 10:
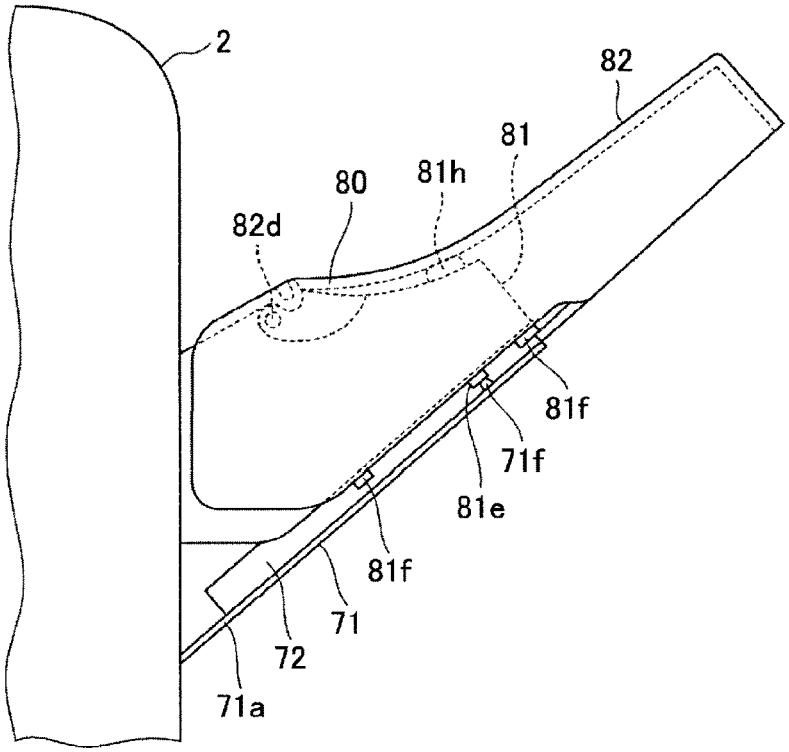
FIG. 10 is a side view illustrating a state where the dustproof cover is detached from the paper loading base which is a main part of the image forming apparatus according to the embodiment.
Figure 11:
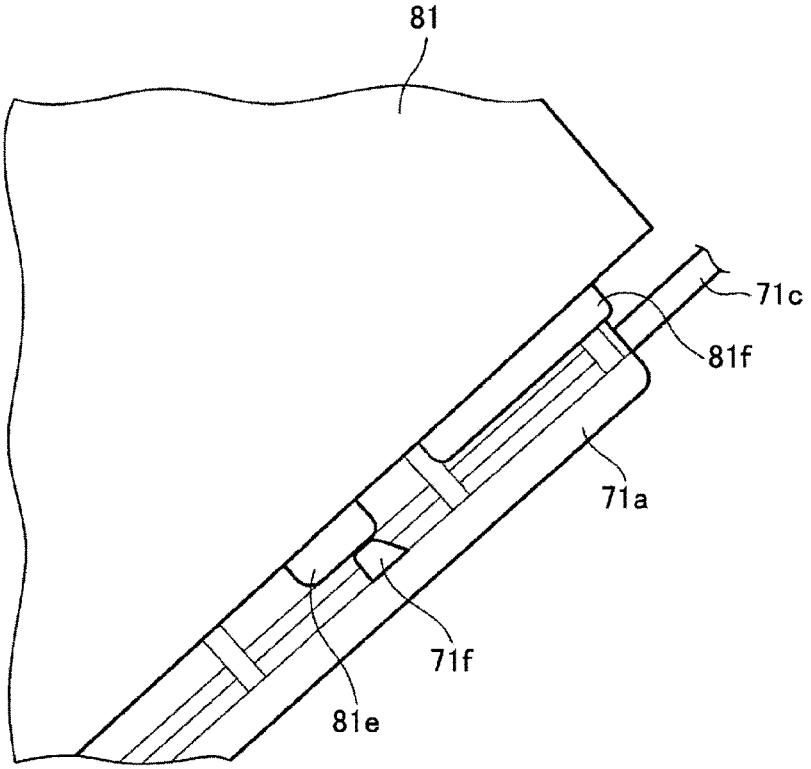
FIG. 11 is a partially enlarged side view illustrating a released state of the locking portion between the paper loading base, which is a main part of the image forming apparatus according to the embodiment, and the dustproof cover.

Next, a case of detaching the base 81 will be described. When the base 81 is moved to the overhang side along the base plate main body 71*a* from the state illustrated in FIG. 5, the floating preventive protrusion 81*d* is detached from the lower end surface of the front wall 2*g*. On the other hand, as illustrated in FIG. 8 and FIG. 9, the second protrusion 81*e* is in contact with the first protrusion 71*f*. For this reason, it is not possible to further move the base 81 to the overhang side along the base plate main body 71*a*. Therefore, even in a case where the external force of unexpectedly moving the base 81 to the overhang side is imparted to the base 81, the base 81 is not separated from a mounting position. In the detachment of the base 81 from the base plate main body 71*a*, as illustrated in FIG. 10 and FIG. 11, the base 81 is lifted by the second protrusion 81*e* in a position in contact with the first protrusion 71*f*, the second protrusion 81*e* is positioned on the upper side from the first protrusion 71*f*, and thus, the base 81 is moved to the overhang side. Such an attachment and detachment operation can be performed by clipping the vicinity of a rotation fulcrum between the base 81 and the opening-and-closing cover 82 without grabbing the base 81.

Figure 13:
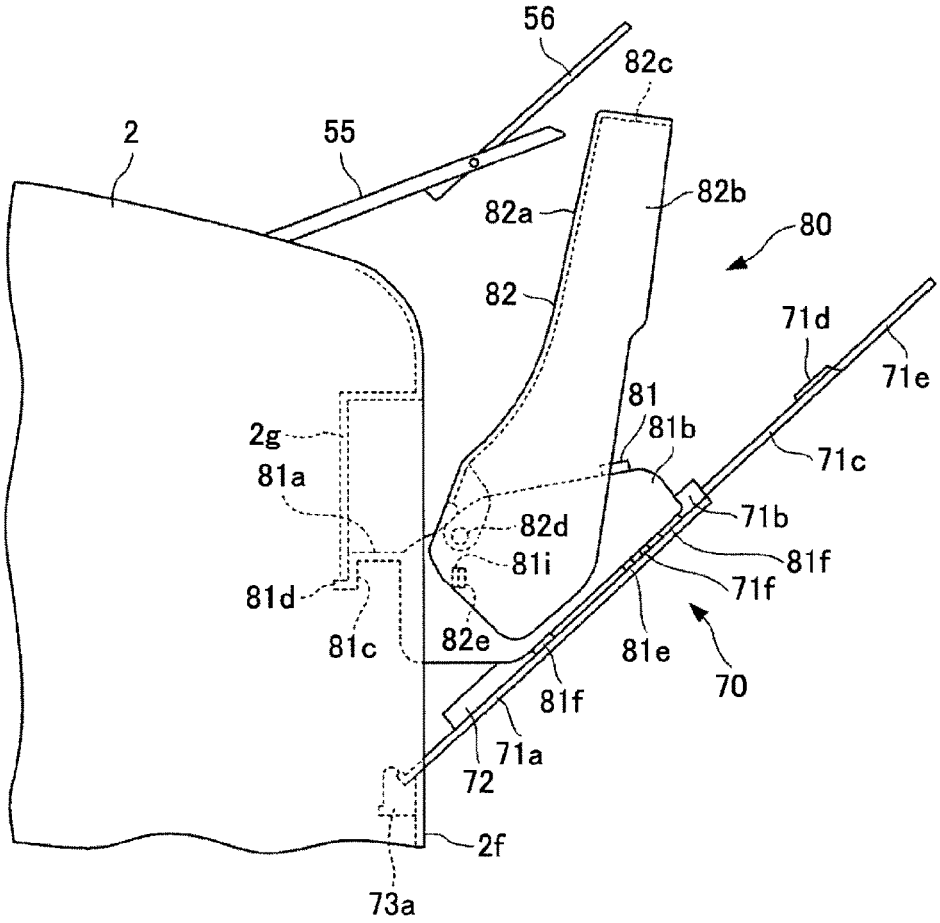
FIG. 13 is a side view illustrating a state where the opening-and-closing cover of the dustproof cover, which is a main part of the image forming apparatus according to the embodiment, is opened not to interfere with an extension tray for receiving ejected paper.

As illustrated in FIG. 13, the opening-and-closing cover 82 is configured to be stopped in a state where the opening-and-closing cover 82 is widely opened up to a position close to the extension tray for receiving ejected paper 55 on the upper side. In this embodiment, the base 81 and the opening-and-closing cover 82 include a base-side engaging protrusion 81*i* and a cover-side engaging protrusion 82*e*, respectively, which are separated from each other on the device main body 2 side from the rotation center of the opening-and-closing cover 82. The base-side engaging protrusion 81*i* and the cover-side engaging protrusion 82*e* are in contact with each other such that opposing oblique surfaces ride on each other on a slightly front side from the position where the opening-and-closing cover 82 is close to the extension tray for receiving ejected paper 55 on the upper side and stopped. When the opening-and-closing cover 82 is further opened, the pair of base-side lateral surface parts 81*b* are bent to slightly widen, and thus, the cover-side engaging protrusion 82*e* is capable of riding over the base-side engaging protrusion 81*i*. When the opening-and-closing cover 82 is released from a hand, the cover-side engaging protrusion 82*e* is in contact with the base-side engaging protrusion 81*i* in a position where the cover-side engaging protrusion 82*e* rides over the base-side engaging protrusion 81*i*, and thus, the opening-and-closing cover 82 is stopped in the state where the opening-and-closing cover 82 is widely opened up to the position close to the extension tray for receiving ejected paper 55 on the upper side. Instead of the cover-side engaging protrusion 82*e* and the base-side engaging protrusion 81*i*, a pair of recess portion and protrusion which detachably engage with each other may be disposed by being divided on facing surfaces of the base 81 and the opening-and-closing cover 82 such that the pair of recess and protrusion engage with each other when the opening-and-closing cover 82 is widely opened up to the position close to the extension tray for receiving ejected paper 55 on the upper side.

Figure 14:
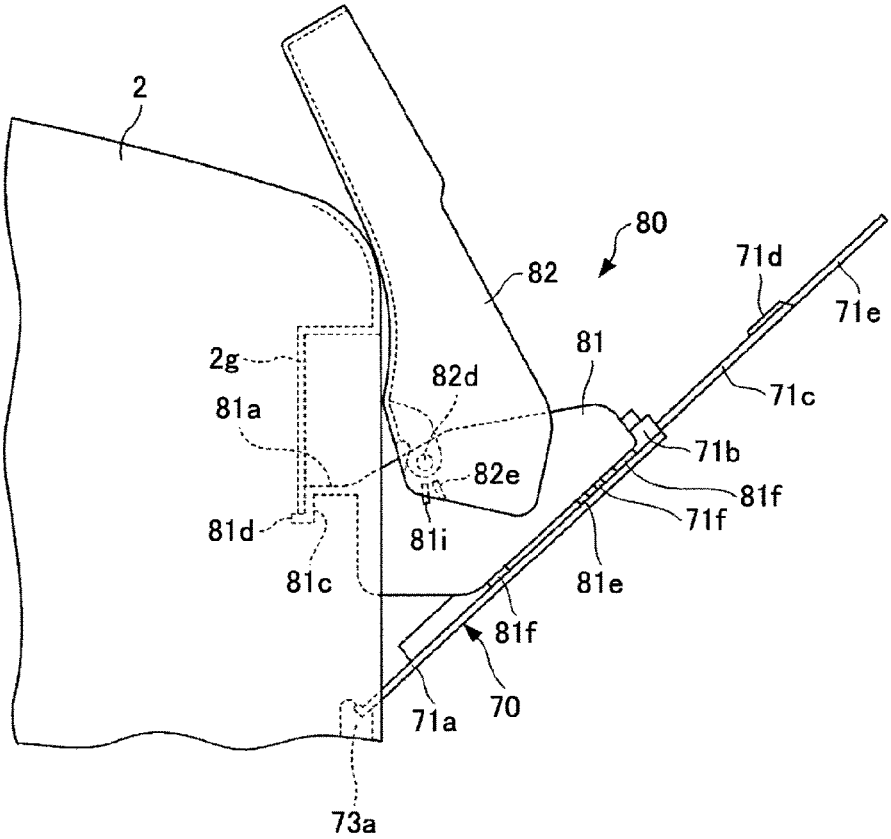
FIG. 14 is a side view illustrating a state where the opening-and-closing cover of the dustproof cover, which is a main part of the image forming apparatus according to the embodiment, is maximally opened.

As illustrated in FIG. 14, in a state where the extension tray for receiving ejected paper 55 does not overhang, the opening-and-closing cover 82 is configured to be stopped in a state of being leaned in contact with the upper end of the device main body 2. In this embodiment, in the state where the extension tray for receiving ejected paper 55 does not overhang, the opening-and-closing cover 82 is formed such that a centroid position of the opening-and-closing cover 82 when the opening-and-closing cover 82 is opened and is in a state of being leaned on the upper end of the device main body 2 is close to the device main body 2 side from the position of the rotation center of the opening-and-closing cover 82. Thus, the opening-and-closing cover 82 is configured to be stopped in a state of being leaned in contact with the upper end of the device main body 2. The pair of recess and protrusion which detachably engage with each other, are provided by being divided in each portion in contact with the opening-and-closing cover 82 and the upper end of the device main body 2, and thereby, the opening-and-closing cover 82 may be stopped in a leaned state.

According to the printer device 1 of this embodiment described above, the dustproof cover 80 is provided in which the attachment and the detachment with respect to the paper loading base 70 are easily performed by a solid configuration, and the replenishment of the manual-feed paper S2 is easily performed since the dustproof cover 80 can be retained in a widely opened state without being detached. That is, the dustproof cover 80 can be solidly configured of the base 81 and the opening-and-closing cover 82 and can be assembled by only inserting the base 81 to the paper loading base 70, and only the opening-and-closing cover 82 is widely opened, and thus, the replenishment of the manual-feed paper S2 is easily performed.

In addition, according to the printer device 1 of this embodiment, when an opening and closing operation of the opening-and-closing cover 82 is performed, for example, at the time of replenishing the paper by setting the detachment of the user as an unexpected operation, it is difficult to detach the dustproof cover 80. That is, the second protrusion 81*e* disposed base 81 side is in contact with the first protrusion 71*f* disposed on the paper loading base 70 side by only allowing the dustproof cover 80 to slide to the overhang side, and thus, the detachment is not performed, and in a case where the base 81 is lifted and is allowed to slide to the outside, the second protrusion 81*e* detours to the upper side with respect to the first protrusion 71*f*, and thus, the detachment can be performed. In this regard, the operability of the detachment of the dustproof cover has not been considered in the printer device of the related art.

In addition, according to the printer device 1 of this embodiment, when the base 81 is mounted on the paper loading base 70 in a state of being inserted to the device main body 2, the floating preventive protrusion 81*d* is closely in contact with the downward surface portion in the device main body 2, and the base 81 does not float from the paper loading base 70, and thus, even in a case where a downward external force is imparted to the overhang end of the opening-and-closing cover 82, there is no concern that the base 81 is detached from the paper loading base 70, and the dustproof cover 80 drops out from the paper loading base 70.

In addition, according to the printer device 1 of this embodiment, the extension tray for receiving ejected paper 55 is provided to overhang to the upper side of the device main body 2 on the paper loading base 70 side, and thus, the extraction operation of the paper ejection and the paper replenishment operation are performed on the front side of the printer device 1, and the operability is improved. Further, even in a case where the extension tray for receiving ejected paper 55 is provided on the upper side of the paper loading base 70 side, it is possible to allow the opening-and-closing cover 82 to stand on itself own in a widely opened state at the time of replenishing the paper onto the paper loading base 70, and to solve the burden at the time of replenishing the paper in the printer device of the related art, that is, the burden that the opening-and-closing cover is retained in the leaned state by one hand, and the paper replenishment has to be performed by the other hand at the time of replenishing the paper.

Further, according to the printer device 1 of this embodiment, it is not necessary to provide a space for containing the dustproof cover in the device main body, and thus, it is possible to downsizing the printer device 1, compared to the printer device of the related art in which the dustproof cover is not attachable and detachable.

The image forming apparatus of the present invention has an effect of including the dustproof cover in which the attachment and the detachment of the dustproof cover with respect to the paper loading base are easily performed, and the replenishment of the manual-feed paper is easily performed since the dustproof cover can be retained in a widely opened state without being detached, and is effective in the overall image forming apparatus such as a printer and a copier provided with a manual paper feeding mechanism including the dustproof cover.

The above-described embodiments are illustrative and do not limit the present invention. Thus, numerous additional modifications and variations are possible in light of the above teachings. For example, at least one element of different illustrative and exemplary embodiments herein may be combined with each other or substituted for each other within the scope of this disclosure and appended claims. Further, features of components of the embodiments, such as the number, the position, and the shape are not limited the embodiments and thus may be preferably set. It is therefore to be understood that within the scope of the appended claims, the disclosure of the present invention may be practiced otherwise than as specifically described herein.

What is claimed is:

1. An image forming apparatus, comprising:

an image forming unit which forms an image on paper being conveyed on a paper conveyance path provided in a device main body;

a paper loading base on which manual-feed paper is loaded, the paper loading base having a lower end rotatably supported on at least one outer surface portion of the device main body, the paper loading base configured to be opened from an upper end thereof, and the paper loading base configured to be disposed at a desired oblique angle or in an overhang state;

a manual-feed paper conveying unit which is disposed in a position corresponding to the paper loading base in the device main body and configured to convey the manual-feed paper loaded on the paper loading base onto the paper conveyance path one by one;

a dustproof cover which entirely covers paper stored in the paper loading base when the paper loading base is in the overhang state, the dustproof cover including, a base which engages with the paper loading base, and an opening-and-closing cover which is rotatably connected to the base and is opened upwardly, wherein the base includes, a pair of base-side lateral surface parts detachably engaging with a pair of lateral portions of the paper loading base in a direction of a rotation axis of the paper loading base in the overhang state, and a base-side upper surface part of which both ends integrally connect the pair of base-side lateral surface parts;

first protrusions provided on both lateral portions of an upper surface of the paper loading base at desired positions corresponding to the base; and second protrusions respectively corresponding to the first protrusions and provided on respective lower end surfaces of the pair of base-side lateral surface parts at positions closer to the device main body than the first protrusions, wherein the second protrusions are provided to be in contact with the first protrusions when the dustproof cover moves in an overhang direction without being lifted.

2. The image forming apparatus according to claim 1, wherein the opening-and-closing cover includes:

a pair of cover-side lateral surface parts of which end portions close to the base overlap with the pair of base-side lateral surface parts from the outside; and a cover-side upper surface part closing a space between the pair of cover-side lateral surface parts.

3. The image forming apparatus according to claim 1, wherein the base includes a floating preventive engaging protrusion which is configured to be arranged such that the base is closely in contact with a downward surface portion of the device main body at a position where the base covers the paper loading base.

4. The image forming apparatus according to claim 1, further comprising:

a paper ejection port provided in a vertical surface formed in an upper portion of the device main body on a side opposite to the paper loading base with the rotation axis of the paper loading base as a center, wherein the paper ejection port includes a paper ejection roller pair configured to eject paper to an upper surface portion of the device main body on a paper loading base side.

5. The image forming apparatus according to claim 1, further comprising:

an extension tray configured to receive ejected paper, the extension tray further configured to overhang above the device main body on a paper loading base side.

6. The image forming apparatus according to claim 5, wherein the opening-and-closing cover is configured to stop in a widely opened state to be opened up to a position close to the extension tray for receiving ejected paper.

7. The image forming apparatus according to claim 1, further comprising:

a paper reversing unit provided in the device main body, the paper reversing unit configured to reverse the paper so as to form an image on a back surface of the paper by the image forming unit, wherein the paper conveyance path of the manual-feed paper conveying unit intersects with a reversed paper conveyance path of the paper reversing unit, and the paper reversing unit is configured to convey the manual-feed paper which is conveyed from the manual-feed paper conveying unit.

8. The image forming apparatus according to claim 1, wherein the base engages with the paper loading base at a portion close to the device main body.

9. An image forming apparatus comprising:

an image forming unit which forms an image on paper being conveyed on a paper conveyance path provided in a device main body;

a paper loading base on which manual-feed paper is loaded, the paper loading base having a lower end rotatably supported on at least one outer surface portion of the device main body, the paper loading base configured to be opened from an upper end thereof, and the paper loading base configured to be disposed at a desired oblique angle or in an overhang state;

a manual-feed paper conveying unit which is disposed in a position corresponding to the paper loading base in the device main body and configured to convey the manual-feed paper loaded on the paper loading base onto the paper conveyance path one by one;

a dustproof cover which entirely covers paper stored in the paper loading base when the paper loading base is in the overhang state, the dustproof cover including, a base which engages with the paper loading base, and an opening-and-closing cover which is rotatably connected to the base and is opened upwardly; and an extension tray configured to receive ejected paper, the extension tray further configured to overhang above the device main body on a paper loading base side, wherein the opening-and-closing cover is configured to be stopped in a state in which the opening-and-closing cover is leaned such that the opening-and-closing cover is in contact with an upper end of the device main body, when the extension tray for receiving ejected paper does not overhang above the device main body.

* * * * *